US009662522B2

(12) United States Patent
Liu et al.

(10) Patent No.: US 9,662,522 B2
(45) Date of Patent: May 30, 2017

(54) FIRE EXTINGUISHING COMPOSITION CONTAINING SACCHARIDE AND SACCHARIDE DERIVATIVE

(75) Inventors: Yi Liu, Xi'an (CN); Junna Yao, Xi'an (CN); Zhanjun Yang, Xi'an (CN)

(73) Assignee: XI'AN J&R FIRE FIGHTING EQUIPMENT CO., LTD, Xi'an (CN)

( * ) Notice: Subject to any disclaimer, the term of this patent is extended or adjusted under 35 U.S.C. 154(b) by 236 days.

(21) Appl. No.: 14/374,723

(22) PCT Filed: Aug. 16, 2012

(86) PCT No.: PCT/CN2012/080267

§ 371 (c)(1),
(2), (4) Date: Jul. 25, 2014

(87) PCT Pub. No.: WO2013/071783

PCT Pub. Date: May 23, 2013

(65) Prior Publication Data

US 2014/0374641 A1 Dec. 25, 2014

(30) Foreign Application Priority Data

Nov. 20, 2011 (CN) ..... 2011 1 0462660

(51) Int. Cl.

| | |
|---|---|
| ***A62D 1/06*** | (2006.01) |
| ***A62C 5/00*** | (2006.01) |
| ***A62D 1/00*** | (2006.01) |

(52) U.S. Cl.

CPC ..... *A62D 1/06* (2013.01); *A62C 5/004* (2013.01); *A62C 5/006* (2013.01); *A62D 1/0007* (2013.01)

(58) Field of Classification Search

None

See application file for complete search history.

(56) References Cited

U.S. PATENT DOCUMENTS

| | | | | |
|---|---|---|---|---|
| 4,194,979 | A * | 3/1980 | Gottschall | A62D 1/0014 252/5 |
| 5,800,830 | A * | 9/1998 | Asano | A21D 2/14 424/439 |
| 6,217,788 | B1 | 4/2001 | Wucherer et al. | |
| 6,780,991 | B2 | 8/2004 | Vandersall et al. | |
| 2003/0038272 | A1 | 2/2003 | Figiel et al. | |
| 2004/0020502 | A1* | 2/2004 | Tosas Fuentes | A24D 1/02 131/284 |
| 2006/0217469 | A1* | 9/2006 | Bauer | C08K 3/22 524/115 |
| 2010/0093882 | A1* | 4/2010 | Ohama | C08G 73/00 521/163 |
| 2010/0329960 | A1 | 12/2010 | Blanchard | |
| 2011/0089087 | A1* | 4/2011 | Politi | A61J 3/10 209/22 |
| 2013/0181158 | A1 | 7/2013 | Guo et al. | |

FOREIGN PATENT DOCUMENTS

| | | | |
|---|---|---|---|
| CA | 2772639 | A1 | 7/2011 |
| CN | 101757760 | A | 6/2010 |
| CN | 101810919 | A | 8/2010 |
| CN | 101862517 | A | 10/2010 |
| CN | 102179024 | A | 9/2011 |
| CN | 102179026 | A | 9/2011 |
| EP | 1416032 | A1 | 5/2004 |
| FR | 2244052 | A1 | 4/1975 |
| JP | 53-19697 | A | 2/1978 |
| JP | 58-112565 | A | 7/1983 |
| JP | 61-197659 | A | 9/1986 |
| JP | 2004-154165 | A | 6/2004 |

(Continued)

OTHER PUBLICATIONS

International Preliminary Report on Patentability issued May 20, 2014 re: PCT/CN2012/080266; 8 pages; citing: CN101757760A and CN102179024A.

International Search Report issued Nov. 22, 2012; re: PCT/CN2012/080266; citing: CN 101757760 A, CN 102179024 A, CN 102179026 A, JP 58-112565 A and JP 61-197659 A.

Written Opinion issued Nov. 22, 2012 re: PCT/CN2012/080266; 7 pages; citing: CN101757760A and CN102179024A.

International Preliminary Report on Patentability issued May 20, 2014; ref: PCT/CN2012/080267; 6 pages; citing: CN101862517A and CN101810919A.

International Search Report issued Nov. 22, 2012; re: PCT/CN2012/080267; citing: CN 101862517 A, CN 101810919 A, JP 53-19697 A, EP 1416032 A1, JP 2004-154165 A and US 2003/0038272 A1.

Written Opinion issued Nov. 22, 2012 re: PCT/CN2012/080267; 5 pages; citing: CN101862517A and CN101810919A.

*Primary Examiner* — Joseph D Anthony

(74) *Attorney, Agent, or Firm* — Cantor Colburn LLP

(57) ABSTRACT

The present disclosure relates to a fire extinguishing composition containing saccharide and a saccharide derivative, comprising a saccharide derivative, a saccharide material and an auxiliary fire extinguishing agent, whose mass percentages are respectively: saccharide derivative 30%-60%, saccharide material 10%-40%, and auxiliary fire extinguishing agent 10%-30%. The fire extinguishing composition uses a pyrotechnic agent as a heat source and a power source, is heated and decomposed or reacts by using the heat of burning of the pyrotechnic agent, to generate a fire extinguishing material to be sprayed together with the fireworks agent, thereby achieving the fire extinguishing purpose. The fire extinguishing composition of the present disclosure uses a saccharide derivative and a saccharide material as primary ingredients, uses a pyrotechnic agent as a heat source and a power source, and is easily decomposed after being heated to generate non-toxic and harmless gas. The environment is not polluted after the ejection, the effective utilization rate of components is high, and the material obtained through decomposition can also extinguish fire, so as to generate a synergistic action on the pyrotechnic agent, thereby improving the fire extinguishing performance of the whole fire extinguishing composition.

5 Claims, No Drawings

(56) References Cited

FOREIGN PATENT DOCUMENTS

| | | | |
|---|---|---|---|
| RU | 1819644 | C | 6/1993 |
| RU | 2091106 | C1 | 9/1997 |
| WO | 2012034494 | A1 | 3/2012 |

* cited by examiner

FIRE EXTINGUISHING COMPOSITION CONTAINING SACCHARIDE AND SACCHARIDE DERIVATIVE

TECHNICAL FIELD

The present disclosure relates to the technical field of fire prevention and extinguishment, and more particularly to a fire extinguishing composition containing saccharide and a saccharide derivative.

BACKGROUND

Aerosol fire extinguishing technology, which has been used as one of the noticeable alternative technologies of Halon in recent years, has been accepted by people and is being applied widely.

Generally, an aerosol fire extinguishing agent will release an aerosol and a large amount of heat after combustion reaction so that the temperature of a fire extinguishing apparatus is relatively high. On one hand, a temperature that is too high will burn an operator etc. On the other hand, a secondary fire may be caused after spraying. In order to reduce the spraying temperature, a physical cooling method or a chemical cooling method will be applied generally. The physical cooling method is to add a cooling system at the front end of a pyrotechnic agent in the extinguishing apparatus to achieve a cooling effect, which is easy to result in a cumbersome equipment with complex structure, a complicated process and high costs, however. In addition, because of the cooling system, a large amount of active particles are deactivated to greatly reduce the fire extinguishing performance. In addition, the chemical cooling method is to provide a chemical cooling layer in the spraying direction of the pyrotechnic agent. However, existing chemical coolants will affect the fire extinguishing efficacy of the pyrotechnic agent so that the pyrotechnic agent can hardly penetrate through a fire plume to reach the root of a fire source to inhibit the fire source rapidly and effectively. Additionally, most chemical coolants will be decomposed to generate a certain amount of gas particles toxic to human body, which is not beneficial for environment protection.

SUMMARY

To solve disadvantages existing in chemical coolants in the prior art, the present disclosure provides a novel fire extinguishing composition containing saccharide and a saccharide derivative.

The following technical solution to solve technical problems is as follows:

a fire extinguishing composition containing saccharide and a saccharide derivative, including a saccharide derivative, a saccharide material and an auxiliary fire extinguishing agent, whose mass percentages are respectively:

saccharide derivative 30%-60% saccharide material 10%-40% auxiliary fire extinguishing agent 10%-30%

The fire extinguishing composition uses a pyrotechnic agent as a heat source and a power source, is heated and decomposed or reacts by using the heat of burning of the pyrotechnic agent, to generate a fire extinguishing material to be sprayed together with the pyrotechnic agent, thereby achieving the fire extinguishing purpose.

Further, the saccharide derivative is one or more of sodium gluconate, potassium gluconate, zinc gluconate, calcium gluconate, magnesium gluconate, copper gluconate, ferrous gluconate or manganese gluconate.

Further, the saccharide material is more or more of dextrin, glucose, chitosan, starch or fructose.

The auxiliary fire extinguishing agent in the fire extinguishing composition containing saccharide and a saccharide derivative of the present disclosure is an organic salt.

Further, the organic salt is one or more of sodium oxalate, potassium oxalate, potassium citrate, sodium citrate, potassium tartrate, sodium tartrate, potassium bitartrate, sodium bitartrate, potassium dihydroxytartrate, potassium sodium tartrate, potassium acetate, sodium acetate, ammonium acetate, hexamethylene tetramine or sodium methoxide.

The fire extinguishing composition of the present disclosure further includes a performance additive in a mass percentage of 2% to 18%.

Further, the performance additive is one or more of magnesium stearate, zinc stearate, acetal glue, hydroxypropyl methyl cellulose, sodium carboxymethyl cellulose or phenolic resin.

Components and mass percentages in the fire extinguishing composition of the present disclosure are as follows:

saccharide derivative 35%-55% saccharide material 15%-35% auxiliary fire extinguishing agent 12%-24% magnesium stearate 2% to 10%

The fire extinguishing composition containing saccharide and a saccharide derivative of the present disclosure mainly has the following advantages:

1. the fire extinguishing composition of the present disclosure uses a saccharide derivative and a saccharide material as primary ingredients; the saccharide material, which is a carbohydrate and easy to decompose under heat to generate products including CO, water and $CO_2$ etc., is non-toxic and harmless, thus sprayed substances is pollution-free to the environment; metal particles in the saccharide derivative can be combined with free radicals in flame combustion reaction after being decomposed to stop the combustion reaction chain, thus the metal particles can inhibit flames without affecting the environment and the fire extinguishing performance of the whole fire extinguishing composition can be improved;

2. the fire extinguishing composition of the present disclosure contains an auxiliary fire extinguishing agent of organic salt which is able to be decomposed after being heated to generate a great amount of gases, thus increasing the overall gas pressure of a hot aerosol and improving the strength of spraying of the aerosol so that the aerosol can penetrate through a fire plume to cut off a fire source and control the fire source effectively;

3. the present disclosure optimizes contents of the components so that the overall fire extinguishing efficacy of the fire extinguishing composition is high and effective utilization of the components is high;

4. the fire extinguishing composition of the present disclosure is easy to store in a long term with stable performance.

DETAILED DESCRIPTION

The fire extinguishing composition containing saccharide and a saccharide derivative of the present disclosure will be further described in combination with specific embodiments:

the fire extinguishing composition includes a saccharide derivative, a saccharide material, an auxiliary fire extinguishing agent and a performance additive, whose mass percentages are respectively: saccharide derivative 30%-60%, preferably 35% to 55%, saccharide material 10%-40%, preferably 15% to 35%, auxiliary fire extinguishing agent 10%-30%, preferably 12% to 24%, performance additive 2% to 18%, preferably 2% to 10%, wherein the saccharide derivative can be selected from one or more of sodium gluconate, potassium gluconate, zinc gluconate, calcium gluconate, magnesium gluconate, copper gluconate, ferrous gluconate or manganese gluconate; the saccharide material can be selected from one or more of dextrin, glucose, chitosan, starch or fructose; the auxiliary fire extinguishing agent is an organic salt, specifically one or a combination of several of sodium oxalate, potassium oxalate, potassium citrate, sodium citrate, potassium tartrate, sodium tartrate, potassium bitartrate, sodium bitartrate, potassium dihydroxytartrate, potassium sodium tartrate, potassium acetate, sodium acetate, ammonium acetate, hexamethylene tetramine or sodium methoxide; the performance additive is one or more of magnesium stearate, zinc stearate, acetal glue, hydroxypropyl methyl cellulose, sodium carboxymethyl cellulose or phenolic resin; the composition uses a pyrotechnic agent as a heat source and a power source, is heated and decomposed or reacts by using the heat of burning of the pyrotechnic agent, to generate a fire extinguishing material.

The specific fire extinguishing mechanism is that: the fire extinguishing composition can decompose to release a fire extinguishing substance at high temperature; the fire extinguishing substance can react with one or more of O•, OH•, H• free radicals which are necessary for chain combustion reaction through free radicals to stop the chain combustion reaction, and also can reduce the partial pressure of oxygen via physical effect to inhibit flames; or have physical and chemical inhibition effects simultaneously to realize fire extinguishment jointly; at the same time, synergistic interaction can be generated with a pyrotechnic agent, thus further improving the fire extinguishing efficacy of the fire extinguishing agent and greatly shortening the effective fire extinguishing time.

A total amount of 100 g of the gluconates, the saccharide material, the auxiliary fire extinguishing agent and the performance additive in the embodiment above according to the proportions in Table 1 as follows was prepared into solid tablets with regular shapes after processes including mixing, pelleting and tablet forming etc.; and then added to a fire extinguishing apparatus containing 100 g of a K-type hot aerosol generator to perform 0.25 $cm^2$ 93# gasoline fire extinguishing test comparison according to standards of BS6165: 2002 Specification for small disposable fire extinguishers of the aerosol type with fire extinguishing agents in the prior art (100 g of an S type fire extinguishing agent, 100 g of a K type fire extinguishing agents) in the same conditions, and results are as shown in Table 1.

TABLE 1

Comparison in components of compositions and test results

| components of composition | | Component content (mass percent) of embodiments | | | | | | | | Comparison example | |
|---|---|---|---|---|---|---|---|---|---|---|---|
| | | 1 | 2 | 3 | 4 | 5 | 6 | 7 | 8 | 1 | 2 |
| Saccharide derivative | Commercially available S type fire extinguishing agent | | | | | | | | | • | |
| | Commercially available K type fire extinguishing agent | | | | | | | | | | • |
| | Sodium gluconate | 35 | | 50 | 25 | | | 40 | | | |
| | Potassium gluconate | | 55 | | 23 | | 20 | | | | |
| | Copper gluconate | | | | | 45 | | | 30 | | |
| | Ferrous gluconate | | | | | | 35 | | 20 | | |
| Saccharide material | Dextrin | 35 | | | | | | 15 | 17 | | |
| | Starch | | 15 | | | | | 20 | | | |
| | Glucose | | | 28 | 20 | | | | | | |
| | Fructose | | | | | 25 | | | | | |
| | Chitosan | | | | | | 13 | | 15 | | |
| | Hexamethylene tetramine | 23 | | | | | | | | | |
| | Potassium citrate | | 23 | | | | | 10 | | | |
| | Sodium methoxide | | | 15 | | | | | | | |
| | Potassium hydrogen tartrate | | | | 24 | | | | | | |
| | Sodium acetate | | | | | 20 | | | | | |
| | Sodium oxalate | | | | | | 24 | | 18 | | |

TABLE 1-continued

| Comparison in components of compositions and test results | | | | | | | | | | | |
|---|---|---|---|---|---|---|---|---|---|---|---|
| components of composition | | Component content (mass percent) of embodiments | | | | | | | | Comparison example | |
| | | 1 | 2 | 3 | 4 | 5 | 6 | 7 | 8 | 1 | 2 |
| Performance additive | Hydroxypropyl methyl cellulose | 4 | 4 | | | | | 10 | | | |
| | Magnesium stearate | 3 | 3 | 2 | 3 | 4 | | 5 | | | |
| | Sodium carboxymethyl cellulose | | | 5 | 5 | 6 | 8 | | | | |
| Comparison in test results | | | | | | | | | | | |
| Fire extinguishing situation | | 3 shots extin-guished | 2 shots extin-guished | 3 shots extin-guished | 2 shots extin-guished | 3 shots extin-guished | 3 shots extin-guished | 2 shots extinguished | 3 shots extinguished | 3 shots not extinguished | 3 shots not extinguished |
| Spraying time/s | | 11.23 | 10.98 | 11.35 | 11.12 | 11.54 | 12.12 | 11.86 | 11.71 | 42.36 | 14.65 |

It can be seen from the comparison results in the experiments above that two shots or even all three shots were extinguished by the fire extinguishing compositions in the first to the eighth embodiments while no shot was extinguished by those in the first embodiment and the second embodiment; the spraying time in the first to the eighth embodiments was about 11 s, which was shortened by about 29 s compared with the spraying time in the first embodiment, and was also greatly shortened compared with the second embodiment. Therefore, the fire extinguishing composition of the present disclosure has high spraying intensity with short spraying time, and better fire extinguishing efficacy than fire extinguishing agents in the prior art.

What is claimed is:

1. A fire extinguishing composition, comprising:

a saccharide derivative 30% to 60% by weight, wherein saccharide derivative comprises one or more of sodium gluconate, potassium gluconate, zinc gluconate, calcium gluconate, magnesium gluconate, copper gluconate, ferrous gluconate or manganese gluconate;

a saccharide material 10% to 40% by weight, wherein the saccharide material comprises one or more of dextrin, glucose, chitosan, starch or fructose; and an auxiliary fire extinguishing agent 10% to 30% by weight, wherein the auxiliary fire extinguishing agent is an organic salt different from said saccharide derivative.

2. The fire extinguishing composition according to claim 1, wherein the organic salt comprises one or more of sodium oxalate, potassium oxalate, potassium citrate, sodium citrate, potassium tartrate, sodium tartrate, potassium bitartrate, sodium bitartrate, potassium dihydroxytartrate, potassium sodium tartrate, potassium acetate, sodium acetate, ammonium acetate, hexamethylene tetramine or sodium methoxide.

3. The fire extinguishing composition according to claim 1, further comprising a performance additive in a mass percentage of 2% to 18% by weight.

4. The fire extinguishing composition according to claim 3, wherein the performance additive comprises one or more of magnesium stearate, acetal glue, hydroxypropyl methyl cellulose, sodium carboxymethyl cellulose or phenolic resin.

5. The fire extinguishing composition according to claim 4, further comprising:

a saccharide derivative 35% to 55% by weight;

a saccharide material 15% to 35% by weight;

an auxiliary fire extinguishing agent 12% to 24% by weight; and a magnesium stearate 2% to 10% by weight.

* * * * *